US009719530B2

(12) United States Patent
Specks et al.

(10) Patent No.: US 9,719,530 B2
(45) Date of Patent: Aug. 1, 2017

(54) ELECTROHYDRAULIC CONTROL CIRCUIT

(71) Applicant: TTControl GMBH, Vienna (AT)

(72) Inventors: Marcus Specks, St. Ingbert (DE); Marcus Pfeiffer, Ramstein-Miesenbach (DE); Stephan Grün, Püttlingen (DE); Reiner Vierkotten, Oberhausen (DE); Joseph Schnittker, Dortmund (DE); Andreas Lehmann, Moers (DE); Wolfgang Tebeek, Marl (DE); Wolfgang Kemmetmüller, Vienna (AT); Johannes Henikl, Vienna (AT); Andreas Kugi, Vienna (AT)

(73) Assignee: TTControl GmbH, Vienna (AT)

( * ) Notice: Subject to any disclaimer, the term of this patent is extended or adjusted under 35 U.S.C. 154(b) by 94 days.

(21) Appl. No.: 14/783,556

(22) PCT Filed: Apr. 9, 2014

(86) PCT No.: PCT/AT2014/050085

§ 371 (c)(1),
(2) Date: Oct. 9, 2015

(87) PCT Pub. No.: WO2014/165888

PCT Pub. Date: Oct. 16, 2014

(65) Prior Publication Data

US 2016/0084270 A1 Mar. 24, 2016

(30) Foreign Application Priority Data

Apr. 9, 2013 (AT) ..... A50241/2013

(51) Int. Cl.
*F15B 11/00* (2006.01)
*E04G 21/04* (2006.01)
(Continued)

(52) U.S. Cl.
CPC ..... *F15B 11/003* (2013.01); *E04G 21/0436* (2013.01); *E04G 21/0454* (2013.01);
(Continued)

(58) Field of Classification Search
CPC ..... F15B 11/003; F15B 2211/30515; F15B 2211/30565; E04G 21/0436; E04G 21/0454; E04G 21/463
See application file for complete search history.

(56) References Cited

U.S. PATENT DOCUMENTS 3,741,337 A 6/1973 Visinsky
4,718,329 A * 1/1988 Nakajima ..... E02F 9/2203 91/445
(Continued)

FOREIGN PATENT DOCUMENTS

DE 10107139 A1 9/2002
DE 20215838 U1 2/2004
(Continued)

OTHER PUBLICATIONS

First Office Action dated Feb. 27, 2014 for Austrian Patent Application No. A 50241/2013.
(Continued)

*Primary Examiner* — Thomas E Lazo
(74) *Attorney, Agent, or Firm* — Eversheds Sutherland (US) LLP

(57) ABSTRACT

An electrohydraulic control circuit for driving a hydraulically actuated actuating element (5, 6), by means of which a segment (5.3) of a manipulator, in particular of a large manipulator for truck-mounted concrete pumps, can be adjusted in terms of its orientation, wherein there are provided an electrically driven first valve (2.4), which is connected to hydraulic working lines of the actuating element (5.6) for the drive thereof, and leak-free check valves (2.5, 2.6) provided in the working lines of the actuating element (5.6), which valves are arranged on the actuating element
(Continued)

Figure 1:
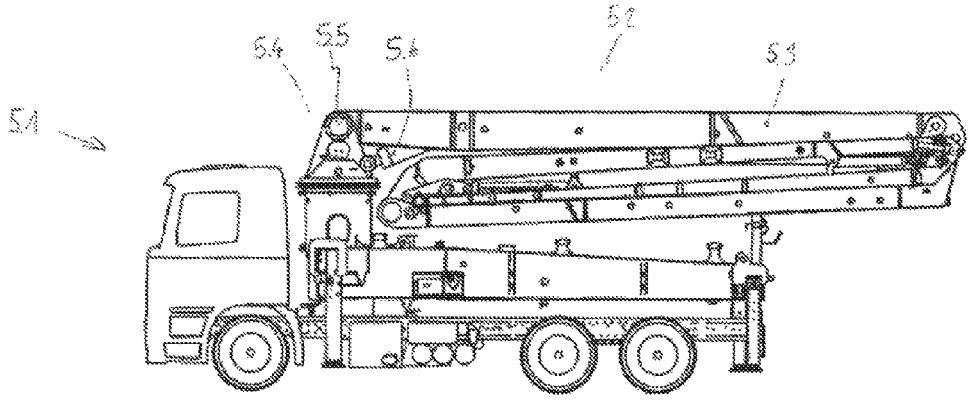

(5.6) or on the segment (5.3) associated with this actuating element (5.6) and can be released for the normal operation of the actuating element (5.6), wherein the release of the check valves (2.5, 2.6) is driven by an electronic control unit (ECU) separate from the first valve (2.4) and the check valves (2.5, 2.6).

19 Claims, 4 Drawing Sheets

(51) Int. Cl.
*F15B 20/00* (2006.01)
*F15B 11/08* (2006.01)

(52) U.S. Cl.
CPC ..... *E04G 21/0463* (2013.01); *F15B 11/08* (2013.01); *F15B 20/005* (2013.01); *F15B 2211/30515* (2013.01); *F15B 2211/30565* (2013.01); *F15B 2211/327* (2013.01); *F15B 2211/8636* (2013.01); *F15B 2211/8757* (2013.01)

(56) References Cited

U.S. PATENT DOCUMENTS

| | | | | |
|---|---|---|---|---|
| 5,860,233 | A | 1/1999 | Roubinet | |
| 6,282,893 | B1 | 9/2001 | Porter | |
| 8,037,682 | B2 * | 10/2011 | Yi ..... | B66C 13/066 60/469 |

FOREIGN PATENT DOCUMENTS

| | | | |
|---|---|---|---|
| EP | 0190703 | B1 | 8/1986 |
| EP | 1882795 | A2 | 1/2008 |
| WO | 2012041076 | A1 | 4/2012 |

OTHER PUBLICATIONS

International Search Report for PCT/AT2014/050085 dated Aug. 7, 2014.

* cited by examiner

ELECTROHYDRAULIC CONTROL CIRCUIT

The invention relates to an electrohydraulic control circuit for driving a hydraulically actuated actuating element, by means of which a segment of a manipulator, in particular of a large manipulator for truck-mounted concrete pumps, can be adjusted in terms of its orientation.

The invention also relates to a regulation system for controlling the orientation of a segment of a manipulator, in particular of a large manipulator for truck-mounted concrete pumps, wherein the segment is connected via a joint to a base or a preceding segment of the manipulator and can be pivoted at the joint relative to the base or the preceding segment about at least one axis of rotation by means of at least one actuating element, preferably a hydraulic actuating element.

Electrohydraulic control circuits currently used or regulation systems associated therewith, as are used for example to drive multi-membered large manipulators for truck-mounted concrete pumps, generally have a central control block, wherein individual segments can be driven individually. For this purpose, hydraulic actuating elements are associated with the segments, which actuating elements can be selectively operated electrohydraulically by means of pilot valves or manually via hand levers. The hydraulic actuating elements are generally embodied as hydraulic cylinders, wherein the deflection of a piston received in the cylinder correlates with the deflection of an associated segment. To damp elastic vibrations, algorithms are utilised in the systems currently used, in accordance with which algorithms the pressure difference of the chamber pressure of the respective cylinder is fed back to the control valve belonging to the cylinder. In order to prevent a drift of the segments caused by the feedback and in order to enable a load regulation, known systems are often equipped with geodetic angle or inclination sensors.

The electrohydraulic control circuits described in the introduction or regulation systems associated therewith have numerous disadvantages, which will be explained as follows. The use of a central control block requires considerable line lengths, for example up to 70 m, between the hydraulic cylinders and the valves controlling said cylinders. Long lines, however, impair the response behaviour of the electrohydraulic control circuit on account of delays, increase the susceptibility to line breaks, limit the space available at the segments, and increase the costs of the electrohydraulic control circuit. Furthermore, in order to avoid an undesirable lowering of a segment, lowering brake valves must often be used, which open only at a corresponding pressure in the associated hydraulic feed lines (and control valve actuated therewith). Since each opening process involves a period of time, these lead to an additional delay and a further deterioration of the response behaviour. The frequent changes of the movement direction, which are to be expected with an active regulation, cause a relentless opening and closing of the lowering brake valves. In particular, an opening state of the involved valves, which is undefined at slow movement speeds, induces elastic vibrations of the segments. Since the pressure supply of the electrohydraulic control circuit does not constitute a constant pressure system and the supply pressure influences the response behaviour, additional delays may occur on account of the level of the supply pressure. Electrohydraulic control circuits, which are used exclusively in hardware, cannot be used in a versatile manner and cannot be adapted to the respective operation.

On account of these weaknesses, the currently used electrohydraulic control circuits or regulation systems associated therewith are not suitable for the implementation of highly dynamic regulation strategies. The response behaviour delayed by the described effects has a particularly negative effect on the control of the segments, in particular at slow movement speeds.

Document EP 1 882 795 B1 presents a large manipulator, in particular for truck-mounted concrete pumps, having a mast block, which is arranged on a frame and is preferably rotatable about a vertical axis of rotation, having a bendable mast composed of at least three mast arms. In order to determine a time-dependent measurand derived from the mechanical vibrations of a mast arm in question, pressure sensors are provided, wherein a pressure sensor is mounted on a bottom-side end and on a rod-side end of each piston and the corresponding time-dependent measurement signal delivers the pressure difference.

The utilised systems, which are typically used for the active damping of elastic vibrations, have the following disadvantages: pressure sensors used therein do not directly measure the dynamic states of the segment. Vibrations that act on (for example on account of a static friction) stationary hydraulic cylinders therefore cannot be determined. Furthermore, unconsidered dynamic effects, which for example are caused by a non-ideal pressure supply, may have a direct influence on measurement signals to be fed back and therefore reduce the performance of the electrohydraulic control circuit or of the associated regulation system.

The object of the invention is therefore to create an electrohydraulic control circuit for controlling a hydraulically actuated actuating element or a regulation system, with which the above-mentioned disadvantages of the prior art are overcome.

In a first aspect of the invention this object is achieved with an electrohydraulic control circuit according to the invention of the type mentioned in the introduction, in which there are provided an electrically driven first valve, which is connected to hydraulic working lines of the actuating element for the drive thereof, and check valves provided in the working lines of the actuating element, which check valves are arranged on the actuating element or the segment associated with said actuating element and can be released for the normal operation of the actuating element, wherein the release of the check valves is controlled by an electronic control unit separate from the first valve and the check valves.

Thanks to this solution according to the invention it is possible to overcome the disadvantages of the prior art discussed in the introduction and to create an electrohydraulic control circuit that is safe and robust, has high reliability and can be adapted efficiently to the respective use and used in a versatile manner. It is particularly favourable here when the check valves are leak-free. The use of an electronic control unit allows the use of software, whereby the invention can be used in a particularly versatile manner and can be adapted quickly to given requirements. Furthermore, the electronic control unit allows a simple control/regulation of the movement speed and the actuating force of the actuating element. Generally, the terms "drive", "control" and "regulate" throughout this application are not to be interpreted as limiting, unless otherwise specified. A control by feedback of signals may thus also be used for regulation, a regulation system may perform control tasks, and the term "drive" is to be understood to mean both a regulation and a control.

In a particularly advantageous embodiment the first valve is arranged on the actuating element or segment associated with the actuating element. The line lengths of the working lines between the actuating element and the first valve are thus reduced to a minimum. This improves the response behaviour of the electrohydraulic control circuit, reduces the susceptibility to line breaks, reduces the number of (working) lines guided along the segment or a plurality of segments, thus increases the space available on the segment/the segments, and reduces the costs of the electrohydraulic control circuit.

In order to provide a particularly compact and robust structure of the control circuit, the control unit may be formed as a dedicated electronic unit for the segment, which unit is preferably arranged on the adjusting element or on the segment associated with the adjusting element. Alternatively, the electronic unit could also be mounted on an actuating element associated with the segment or in the direct vicinity thereof.

In a further embodiment of the invention the working lines of the actuating element may be equipped with pressure sensors, of which the signals are fed to the control unit for monitoring the forces and/or moments and/or load acting on the actuating element. The monitoring of the forces and/or moments and/or load acting on the actuating element allows the implementation of numerous auxiliary functions. By way of example, the control circuit may adapt a control variable acting on the actuating element (in particular a state or a position of the electrically driven first valve) directly to the operation and/or a load. Measures for achieving a constant movement speed of a segment ("servocompensation") or also various fail-safe functions (for example the automatic identification of overpressure and the initiation of safety-relevant measures) are mentioned here by way of example.

In an advantageous development of the invention the control circuit, which is supplied by a pressure supply, is developed further by providing a pressure sensor for monitoring the pressure supply, in order to generate a signal, which is fed to the control unit for adaptation of the drive of the first valve to pressure fluctuations detected by the pressure sensor. This enables an adaptation of the pressure supply to the operation and/or the load.

A simple and yet particularly expedient embodiment of the invention is given in that the first valve is embodied as a proportionally acting valve, in particular as a proportional valve. The first valve may be embodied as what is known as a "continuously adjustable valve", which is not switched discretely, but allows a continuous transition of switching positions. A volume flow of a fluid can be set therewith.

The release of the check valves may be performed directly or indirectly. In a favourable variant of the invention the control unit thus may drive a switching valve, which supplies hydraulic release lines of the check valves. In an alternative variant the control unit drives the release of the check valves via electromagnetic actuation. This makes it possible to dispense with additional hydraulic components/lines.

In order to minimise the number of electrical control units and enable a simple accessibility thereof, it may be advantageous to provide a central electronic control unit, which is designed to control a plurality of control circuits of a multiplicity of segments of a manipulator.

The electronic control unit/s enables/enable a versatile and efficient consideration of additional parameters, which may contribute to the improvement of the performance of the control circuit. In a development of the control circuit, sensor means may therefore be associated with the actuating element, which sensor means detect the operating state of the actuating element and/or the spatial orientation of the associated segment and generate corresponding measurement signals, which are guided to an orientation control/regulation unit associated with the segment and/or the manipulator.

In order to further increase the operating reliability of the control circuit, an emergency circuit may be provided. This expediently has, in an advantageous embodiment, a hydraulic emergency circuit connected parallel to the first valve. In addition, the emergency circuit may preferably have at least one controllable switching valve, which is arranged on the actuating element or segment associated with the actuating element and is preferably supplied via a dedicated pressure supply line, and may also have mutually coupled valves for achieving a load-holding function or a lowering brake function.

In a favourable development of the control circuit the emergency circuit additionally has throttles, which are preferably each connected in series with one of the valves of the emergency circuit.

In a particularly advantageous embodiment of the invention, in which at least the first valve is supplied by a pressure supply via an inflow line, a check valve that can be released for the normal operation may be arranged in the inflow line, the release of said check valve being controlled by the electronic control unit. This enables a separation of components/lines arranged downstream of the releasable check valve from the pressure supply, for example such that a disconnection of the pressure supply in the event of a fault of the components/lines (for example line break) is not absolutely necessary. Other components/lines connected to the pressure supply thus can continue to be supplied.

In order to further increase the operating reliability of the control circuit, the working lines of the actuating element may be supplied by a first pressure supply and return system, whereas a second pressure supply and return system independent of the first system is provided to supply control lines of the control circuit.

The invention according to the first aspect also relates to a manipulator, in particular a large manipulator for truck-mounted concrete pumps, which comprises at least one segment, preferably two or more segments, and is arranged on a base preferably rotatable about a vertical axis of rotation, wherein the segment or a first of the segments is connected to the base and the segments are connected to each other in each case via a joint, at which the segment/segments in question can be pivoted relative to the base or relative to one another about fixed axes of rotation by means of at least one hydraulically actuated actuating element, having an electrohydraulic control circuit for controlling the actuating element or at least one of the actuating elements, as discussed previously.

In a second aspect of the invention the above-mentioned object is achieved with a regulation system according to the invention of the type mentioned in the introduction, the regulation system comprising at least the following:

- a first sensor, which is arranged on a segment attached to the joint and delivers a first measurement signal—referred to as a "deformation signal"—corresponding to a deformation of the segment,
- a second sensor, which delivers a second measurement signal—referred to as an "orientation signal"—corresponding to the spatial orientation of the segment attached to the joint, and
- at least one actuating element associated with the joint;

and is designed to process the deformation signal and the orientation signal as input variables and to determine from these, under consideration of a target orientation of the segment associated with the joint, an actuating signal, which is fed to the associated actuating element.

Thanks to this solution according to the invention it is possible to significantly reduce vibrations in the segments and to position or to orientate segments dynamically and exactly. Here, the regulation system may be portrayed in an electronic control unit described hereinafter, which detects and efficiently and quickly processes the measurement signals and outputs the actuating signals. This enables a digital structure of the regulation system, which thus can be parameterised quickly and efficiently and used in a versatile manner.

In a preferred embodiment the second sensor may be a uniaxial or multiaxial rotation rate sensor in combination with a biaxial or triaxial acceleration sensor, of which the measurement signals are processed in order to determine the orientation signal. A triaxial rotation rate sensor is preferably used in combination with a triaxial acceleration sensor. This sensor structure allows a particularly exact determination of the orientation signal.

In a development of the invention an observer, in particular an extended Kalman filter, can be used to process the signals. The quality of the signals thus can be increased additionally.

In order to enable a particularly compact and robust embodiment of the invention, the second sensor may comprise an inertial sensor, preferably an inertial measurement unit (IMU).

In a further aspect of the invention a magnetic field sensor may be used to determine a signal associated with the orientation of the segment, whereby the quality of the measured orientation signal can be further increased.

In order to enable the most efficient possible, accurate and robust measurement of the deformation signal, the first sensor, in a development of the invention, comprises a strain sensor, for example a strain gauge.

Here, it is particularly advantageous when the first sensor is arranged on the segment in a position separate from the actuating element associated with the joint. The first sensor may be arranged on the body of the segment.

In accordance with the second aspect the invention also relates to a manipulator, in particular a large manipulator for truck-mounted concrete pumps, which comprises at least one segment, preferably two or more segments, and is arranged on a base preferably rotatable about a vertical axis of rotation, wherein the segment or a first of the segments is connected to the base and the segments are connected to one another in each case via a joint, at which the segment/segments in question can be pivoted relative to the base or to one another about fixed axes of rotation by means of at least one preferably hydraulic actuating element, characterised in that a regulation system according to one of the preceding claims is associated with at least one of the joints. The problem described at the outset with regard to vibrations of large manipulators is a particularly suitable field of application of the regulation system, enabling a significant improvement of the usability of large manipulators.

The advantages of the regulation system according to the invention may be used particularly comprehensively when a regulation system is associated with a multiplicity of the joints of the manipulator, in particular with each of the joints.

The second aspect of the invention may also be used in the form of a method for controlling the orientation of a segment of a manipulator, in particular of a large manipulator for truck-mounted concrete pumps, wherein the segment is connected via a joint to a base or a preceding segment of the manipulator, wherein the segment can be pivoted at the joint relative to the base or the preceding segment about at least one axis of rotation by means of at least one preferably hydraulic actuating member, characterised in that in a first sensor, which is arranged on a segment attached to the joint, a first measurement signal—referred to as a "deformation signal"—corresponding to a deformation of the segment is obtained, and in a second sensor a second measurement signal—referred to as an "orientation signal"-corresponding to the spatial orientation of the segment attached to the joint is obtained, an actuating signal is determined with use of the deformation signal and the orientation signal as input variables under consideration of a target orientation of the segment associated with the joint, the actuating signal is fed to an actuating element associated with the joint.

This method can be used in a versatile manner and is particularly suitable for controlling (and regulating) the orientation of segments of a manipulator.

Figure 2:
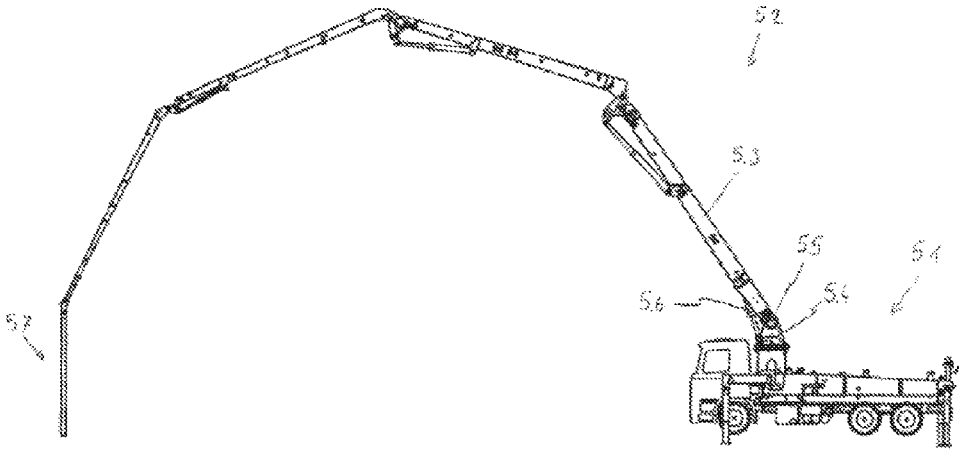
Figure 3:
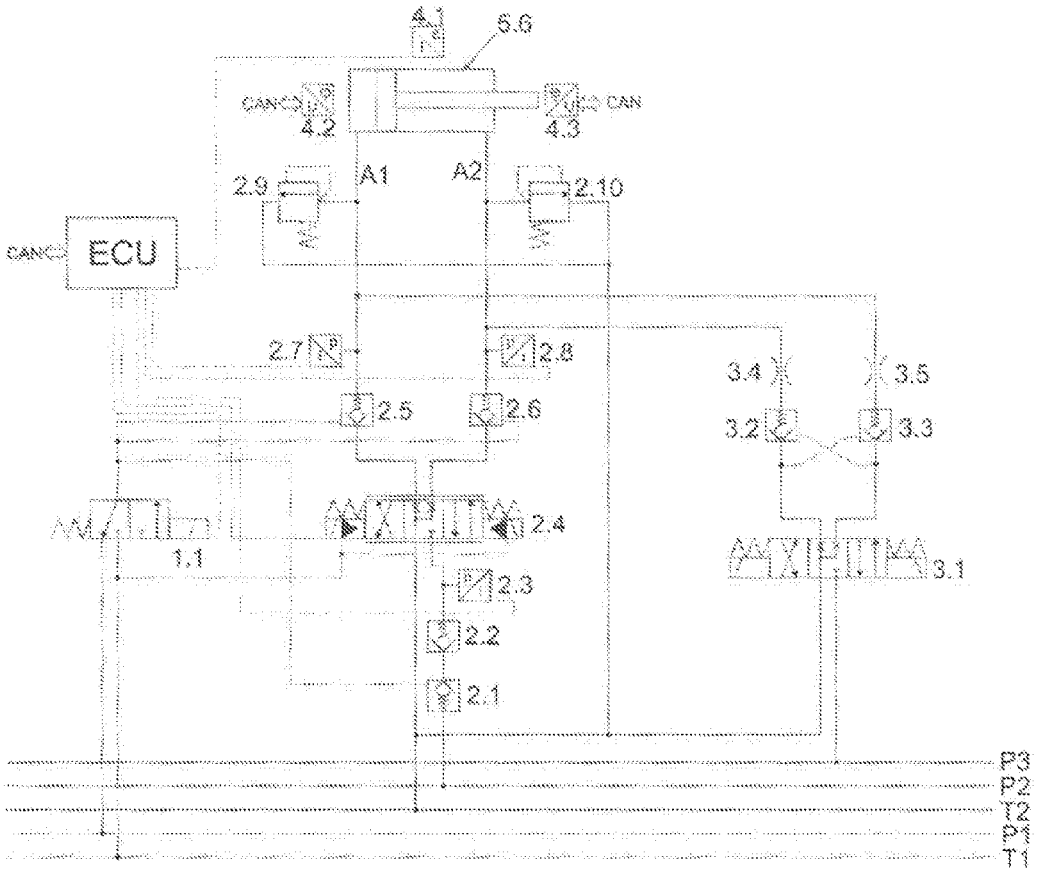
Figure 4:
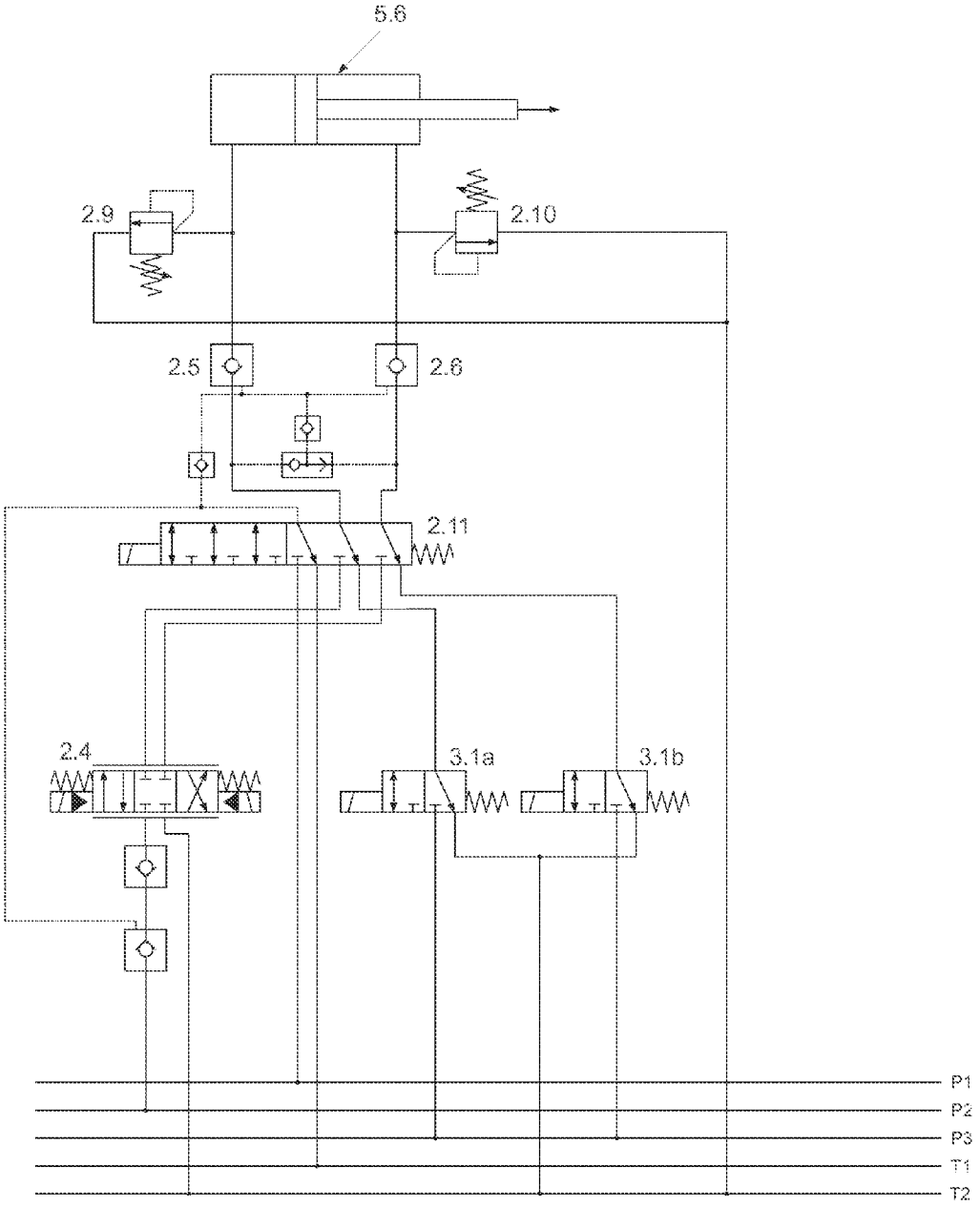
Figure 5:
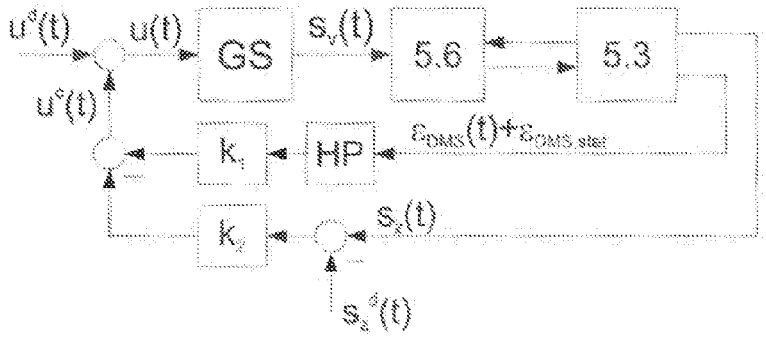
Figure 6:
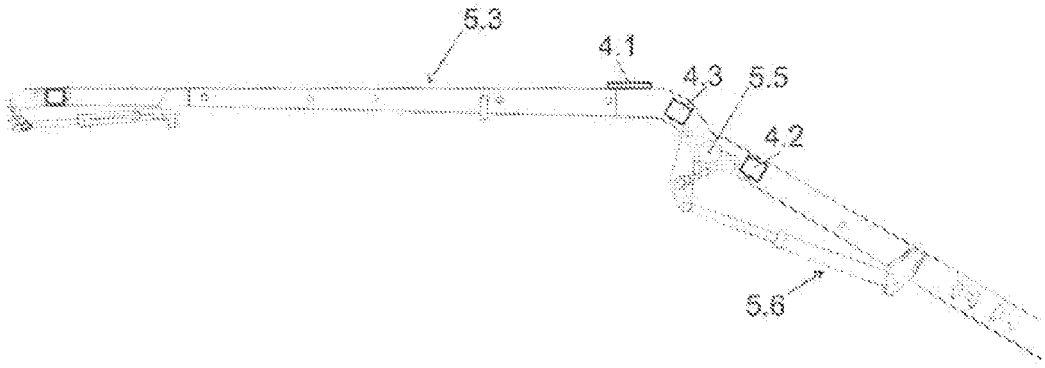

The invention and further embodiments and advantages will be explained in greater detail hereinafter on the basis of a plurality of exemplary, non-limiting embodiments, which are illustrated in the figures, in which FIG. 1 shows a side view of a transport vehicle with a large manipulator in a transporting state, FIG. 2 shows a side view of the transport vehicle according to FIG. 1 with the large manipulator in an operating state, FIG. 3 shows a schematic illustration of a first embodiment of an electrohydraulic control circuit according to the invention, FIG. 4 shows a schematic illustration of a second embodiment of an electrohydraulic control circuit according to the invention, FIG. 5 shows a schematic illustration of a regulation system according to the invention, and FIG. 6 shows a side view of a detail of a boom of the large manipulator FIG. 1.

In FIG. 1 a transport vehicle 5.1 is illustrated in a side view, which vehicle has a large manipulator 5.2, wherein the large manipulator 5.2 has a plurality of segments 5.3. FIG. 1 shows a plurality of segments 5.3, wherein, for easier readability in the illustration, only a first segment 5.3 is provided with a reference sign. The further segments 5.3 may be structured substantially identically, however each further segment 5.3 is connected to a preceding segment 5.3. The first segment 5.3 is connected therein to a base 5.4 via a joint 5.5, wherein the base 5.4 is embodied for example as a slewing gear rotatable about a vertical axis fixed relative to the vehicle. Alternatively, however, the base 5.4 could be designed in any other way—what is essential is that the first segment 5.3 is connected to the base 5.4 via a joint 5.5.

A first actuating element 5.6 is arranged between the base 5.4 and the first segment 5.3 and is preferably formed as a hydraulic cylinder; of course, the actuating element 5.6 may also be embodied differently, for example as a hydraulic motor. The first actuating element 5.6 is designed to pivot the first segment 5.3. The pivot position is fixed by the structural design of the first segment 5.3, the base 5.4, and the joint 5.5 and by a deflection of the actuating element 5.6. In order to pivot the first segment 5.3, a piston arranged with the first segment 5.3 and within the hydraulic cylinder is preferably displaced with the aid of pressure differences acting on the hydraulic cylinder. The first segment 5.3 is connected in the shown embodiment in an articulated manner to further segments 5.3, wherein an actuating element 5.6 is arranged in each case between the preceding segment and the following segment, wherein the actuating element 5.6 enables a pivoting of the individual segments 5.3 relative to one another in the manner described previously.

Within the scope of this disclosure the term "manipulator" is understood to mean a working arrangement, such as an arm, a boom, a lifting mechanism, a lifting frame or a mast, which is suitable for driving the position and/or an orientation of at least one segment 5.3 movable by means of at least one actuating element 5.6, wherein the positioning and/or orientation is/are performed relative to a preceding segment 5.3 or the base 5.4.

FIG. 2 shows the transport vehicle 5.1 with the large manipulator 5.2 in an exemplary operating state. The individual segments 5.3 are pivoted therein in such a way that they together form a sort of bridge, which is suitable for enabling a mass transport via the connection of the individual segments 5.3 towards a location remote from the transport vehicle 5.1. This requirement is provided in particular in the case of large manipulators for truck-mounted concrete pumps, in which liquid concrete is to be pumped over large distances, as will be explained hereinafter in greater detail.

For this purpose, a concrete line (not shown), for example a conveying pipe, is guided along the segments 5.3 and at its end has an outlet 5.7, which for example is embodied as an end tube that hangs down and that can be brought purposefully to a desired point/position on the basis of the orientation of the segments 5.3. On account of the large distances that have to be covered here by means of the large manipulator 5.2 and actuating elements 5.6 driven therein, and also on account of the elasticity and deformation of the components forming the bridge, changes to the pressure in the concrete line, and external ambient influences, such as the effect of gusts of wind and the like, vibrations are created including movements up and down of the large manipulator 5.2, in particular of the individual segments 5.3 and/or of the concrete line, whereby the usability of the large manipulator 5.2 may be restricted and/or in the worst case scenario may pose a danger to the individuals involved. Furthermore, in the case of large manipulators 5.2, safety measures must be provided, which prevent an undesired lowering of individual segments 5.3, as could be caused for example by a line break of a hydraulic line of a hydraulic cylinder.

FIG. 3 shows a schematic illustration of a first embodiment of an electrohydraulic control circuit according to the invention, as can be used in particular for the application in large manipulators 5.2 as described above. For easier readability, the reference signs of the previous figures have been re-used and correspond, unless defined otherwise, to the previous elements. This does not mean, however, that the electrohydraulic control circuit is to be considered as limited to the embodiment shown in the previous figures. In those figures an electrically driven first valve 2.4 can be seen, with which an actuating element 5.6, in particular the hydraulic cylinder, can be moved as a result of said valve acting with a pressure difference on working lines A1, A2 associated with the actuating element 5.6. For this purpose, the working lines are each selectively connected to a first pressure supply system P2 or a first return system T2. The first valve 2.4 may be embodied for example as an electromechanically driven 4/3 proportional valve. The first valve 2.4 may be driven for example directly using proportional magnets or hydraulically via pre-controlled pilot valves by an electronic control unit ECU. The electronic control unit ECU monitors the state of the system, enables the implementation of complex algorithms, provides an interface for communication outwardly via a bus system (for example CAN), and also the possibility to connect a multiplicity of sensors thereto. A switching valve 1.1, which for example is embodied as an electromechanically actuated 3/2 switching valve, acts as a central release valve (this function will be discussed in greater detail hereinafter) and is driven by the electronic control unit ECU. When the switching valve 1.1 is energised by the electronic control unit ECU the switching valve 1.1 switches the control pressure associated with a second pressure supply system P1 to the check valves 2.1, 2.5 and 2.6, whereby these are opened (at the same time) and enable a supply pressure associated with the pressure supply system P2 to be applied to a first working line of an actuating element 5.6 associated with the first valve 2.4, in particular a hydraulic cylinder, depending on the position/state of the first valve 2.4. The check valves 2.1, 2.5 and 2.6 are preferably embodied as releasable one-way valves. The releasable one-way valves preferably have a return spring, whereby, when not energised by the electromagnet associated with the switching valve 1.1, a defined state is produced in which a (low) tank pressure associated with the second return system T1 is connected to the check valves 2.1, 2.5 and 2.6.

The check valves 2.5 and 2.6 perform a load-holding function when the control circuit is in an inactive state. The check valve 2.1 likewise has a safety function, and in particular prevents the check valves 2.5 or 2.6 from being pressed on (by the supply pressure) in the event of a stuck piston in the first valve 2.4 outside the middle position. A further check valve 2.2, which is formed as a one-way valve, serves to mechanically secure the control circuit against a break in a supply line associated with the first pressure supply system P2. Two pressure-limiting valves 2.9 and 2.10 are arranged upstream of the actuating element 5.6 and protect the actuating element 5.6, in particular the hydraulic cylinder, against damage caused by excessively high chamber pressures and thus serve as pressure relief valves. In addition, pressure sensors 2.3, 2.7 and 2.8 are provided, which measure the supply pressure in the active state of the control circuit and the pressures acting on the actuating element 5.6 (in particular the two chamber pressures/working pressures of the hydraulic cylinder). The control circuit in the shown embodiment also has an optional hydraulic emergency circuit (emergency operation branch) particularly advantageously connected parallel to the first valve 2.4, which emergency circuit is supplied with oil via a separate third pressure supply line P3 for availability reasons.

The emergency circuit enables the cylinder to move in the event of failure of the components associated with (or arranged upstream or downstream of) the first valve 2.4. The emergency circuit includes a controllable switching valve 3.1, which for example is provided as an electromechanically driven 4/3 switching valve 3.1 for controlling the movement direction, and two mutually coupled valves 3.2 and 3.3, which are preferably embodied as lowering brake valves connected in the conventional manner. The movement speed can be limited with the aid of downstream throttles 3.4 and 3.5.

The control circuit also has a first sensor or a first sensor means 4.1, which is arranged on a segment 5.3 and delivers a first measurement signal—referred to as a "deformation signal"-corresponding to a deformation of the segment 5.3. In addition, a second sensor or a second sensor means 4.2 is provided, which delivers a second measurement signal—referred to as an "orientation signal"—corresponding to the spatial orientation of the segment 5.3. In addition, a further sensor means 4.3 may be provided, which likewise is used to determine the orientation. The sensor means 4.1, 4.2 and 4.3 may be attached to the electronic control unit ECU for example via bus systems (for example CAN).

The electronic control unit ECU monitors the state and the behaviour of the control circuit or an associated regulation system by means of the available sensors. When the electronic control unit ECU identifies incorrect behaviour, it switches the control circuit or the regulation system independently into a safe state.

The electronic control unit ECU is driven via a BUS system (for example CAN), via which control commands and target values can be transmitted, which for example may be predefined by a user via a user interface (for example using a joystick, levers, etc.). Furthermore, status information of the control circuit or of the regulation system can be transmitted to superordinate control apparatuses. The position of the first valve 2.4 necessary for a desired movement speed may be determined by means of software on the basis of measured pressure conditions. On account of the used sensors, the necessary supply pressure may be transmitted by a local electronic control unit ECU via a BUS system to a superordinate electronic control unit ECU, which for example controls a hydraulic pump.

FIG. 4 shows a schematic illustration of a second embodiment of an electrohydraulic control circuit according to the invention. The number of valves therein responsible for the load-holding function (2.5, 2.6, 3.2 and 3.3) is reduced by having replaced the release valve 1.1 by a 6/2 switching valve 2.11 as selector. The emergency circuit is driven via two switching valves 3.1*a* and 3.1*b*. In FIG. 4 the electronic control unit ECU is not explicitly illustrated, but is to be considered as attached in a manner similar to that in FIG. 3.

In FIG. 5 a schematic illustration of a regulation system according to the invention can be seen, which preferably, but not necessarily, may be added to the previously described control circuit and will be described hereinafter building on this control circuit, for improved comprehension (that already mentioned above applies with respect to the reference signs).

A regulation algorithm associated with the regulation system runs on the electronic control unit ECU, which is designed to control the movement speed of the cylinder, whereby this can be recorded as a control variable of the regulation system. A local feedback of a dynamic component of a first sensor 4.1 delivering a deformation signal, which sensor is embodied in particular as a strain gauge, may be used to damp the entire boom structure (consisting of an aggregation of segments AL (which form a boom, corresponding to the segments 5.3—however just a single segment AL may also be provided)). In order to eliminate a stationary component of the deformation signal, of which the feedback does not attain any damping effect, suitable high-pass filters are used. The joint positions of the joints 5.5 or the deflection of at least one control element 5.6 (and therefore the orientation of the segments 5.3) may thus be actively influenced by the regulation system in particular in the event of the occurrence of elastic vibrations. In the case of pump operation for example of a truck-mounted concrete pump, an intervention of the regulation system could lead to a drift movement of the segments 5.3 and therefore to a deviation from a desired target position. In order to be able to permanently maintain a stationary position, additional sensors 4.2 and 4.3 are therefore provided, which deliver an orientation signal and make it possible to draw a conclusion regarding the position of individual segments 5.3. A resultant regulation law can be seen in FIG. 5, in which a feedback of a local deformation signal $\epsilon_{DMS}(t)$ (which for example is delivered by a sensor 4.2 or 4.3 arranged locally on a segment 5.3), of a measured deflection $s_z(t)$ and a desired target value $s_z^d(t)$ of an actuating element 5.6 (in particular the piston position of a hydraulic cylinder) is provided and is as follows:

$$u^c(t)=k_1\epsilon_{DMS}(t)-k_2(s_z(t)-s_z^d(t))$$

$u^c(t)$ here designates the control variable determined by the regulation law or a desired movement speed of the actuating element 5.6. The local deformation signal $\epsilon_{DMS}(t)$ represents the dynamic component of the measured deformation signal (in particular of a beam curvature of a segment 5.3), which is separated by a high-pass filter HP from a stationary component $\epsilon_{DMS,stat}$. The factors $k_1$ and $k_2$ are amplification factors and are used to parameterise the regulation system. For positive amplification factors $k_1$, $k_2>0$ the regulation system demonstrates asymptotically stable behaviour. Instead of the regulation of the deflection of the actuating element 5.6, the deflection of a joint 5.5 could also be regulated.

The input variable of an actuating element 5.6 is illustrated by the signal $s_v(t)$, which for example describes the piston position of a control valve. The electronic control unit ECU may determine the valve position/s that causes/cause a desired movement speed u(t) of an actuating element 5.6 (i.e. the rate of change of a deflection) (speed controller GS). The signal $u^d(t)$ corresponds to a desired movement speed predefined by a user.

In order to enable a dynamically sophisticated position regulation, inertial sensors in the form of IMUs of the known type are preferably arranged on individual segments 5.3, which can be used to determine the position of the joint 5.5 and/or the deflection of the actuating element 5.6 and/or the orientation of a segment 5.3. An inertial sensor may also be associated with each segment 5.3. Such an inertial sensor consists for example of a triaxial rotation rate sensor in combination with a triaxial acceleration sensor. In addition, and earth's magnetic field sensor may also be provided, which can determine a fixed direction in space deviating from the vertical. Since movements in translation have only a very small influence on rotation rate sensors, measurements thereof can be used to identify and to correct a falsification (deviation from the actual values) of an angle of inclination determined from acceleration values. The angle of inclination is determined by integration of the measured rotation rates and is equalised in a stationary manner by means of the measurements of the acceleration sensors. The measurement error in the event of dynamic (quick) movements of the sensors is thus minimised. For implementation, an observer of the form $$\dot{\hat{\psi}}(t)=-\hat{b}(t)+\dot{\psi}_{DRS}(t)+\hat{k}_1(\psi_{BS}(t)-\hat{\psi}(t))$$

$$\dot{\hat{b}}(t)=\hat{k}_2(\psi_{BS}(t)-\hat{\psi}(t))$$

is used, for example. Here, $\hat{\psi}(t)$ designates the estimated angle of inclination, $\dot{\psi}_{DRS}(t)$ the measured rotation rate in the corresponding axis, and $\psi_{BS}(t)$ the angle of inclination determined by means of the acceleration sensors. The offset or bias of the rotation rate sensor is compensated for by the estimated value $\hat{b}(t)$. With the two parameters $\hat{k}_1$ and $\hat{k}_2$ the dynamics of the observer are influenced. If the estimated angles of inclination of a segment 5.3 after and before a joint 5.5 associated with the segment 5.3 are designated by $\hat{\psi}_n(t)$ and $\hat{\psi}_v(t)$, a joint angle $\phi(t)$ can be determined by forming the difference, $$\phi(t)=\hat{\psi}_n(t)-\hat{\psi}_v(t).$$

In the knowledge of the geometry of a joint construction associated with the joint 5.5, the relationship between the deflection $s_z(t)$ of the actuating element 5.6 and the joint angle $\phi(t)$ can be represented by a function $$s_z(t)=f(\phi(t)).$$

The deflection $s_z(t)$ can be determined in this way analytically or alternatively by measurement.

Due to the direct application of at least one first sensor 4.1 to a segment 5.3, a measurement of improved quality of elastic vibrations is possible. Even with the occurrence of static friction in the actuating element 5.6, a dynamic movement of a segment 5.3 can be detected, in contrast to measurement arrangements based on pressure sensors. Furthermore, the measurement is systematically decoupled from interfering effects caused in the hydraulic system.

Due to the described method for measuring the joint angle $\phi(t)$ or the deflection $s_z(t)$ of an actuating element 5.6, the systematic measurement error can thus be significantly reduced compared with known arrangements. This enables a conversion of a position regulation with much higher quality. The advantages of a compact and robust design are provided with inertial sensors, which are used with preference in the course of the regulation system according to the invention.

The use of inertial sensors, however, offers further advantages. In order to damp a segment 5.3, acceleration values can be measured alternatively for feedback of the deformation signal measured using strain gauges (for example a beam curvature of a segment 5.3), since these acceleration values also represent the forces occurring at individual points of a segment 5.3. Due to the three-dimensional embodiment of the inertial sensors, a damping of the vibrations in the horizontal plane can therefore be achieved with the sensors in addition to the damping of the vibrations and the position regulation in the vertical plane, by feeding back the measured horizontal acceleration to the actuating member of the slewing gear. If the inertial sensor is additionally equipped with an earth's magnetic field sensor, a slewing gear angle can therefore also be monitored and thus also regulated. Due to this multifunctionality of the inertial sensors, a wide range of regulation and control functions can therefore be performed with few components on the whole, which leads to an increase of the availability of the regulation system.

To conclude, it is noted with reference to FIG. 5 that the actuating element 5.6 could also be designated as an "actuator" and at least one segment 5.3 forms what is known as a "boom".

A preferred arrangement of sensors 4.2 and 4.3 on a mast (or on segments 5.3) is illustrated in FIG. 6, which shows a side view of a detail of a boom of the large manipulator according to FIG. 1. The sensors 4.2 and 4.3 are preferably embodied as inertial sensors. Alternatively, just one sensor 4.3 may also be provided. The provision however of both sensors 4.2 and 4.3, which are arranged one before and one after the joint 5.5, increases the redundancy of the measurement signals for determining the orientation of the segment 5.3, whereby the fault tolerance of the regulation system can be increased or measurement errors can be identified and/or corrected. Furthermore, the first sensor 4.1 can be seen, which is preferably embodied as a strain gauge and is placed in an area of the segment 5.3 in which a relevant deformation signal adopts the maximum value. This area is often located in the first 20% of the length extension of the respective segment 5.3.

The invention can be used in a versatile manner and is not limited to the presented embodiments. By way of example, the number of segments may be varied and/or the actuating elements 5.6 may be pneumatic or electrical. The invention is not limited to large manipulators, but can be applied in many other areas. What are essential are the concepts forming the basis of the invention, which in consideration of this teaching can be carried out in multiple ways by a person skilled in the art and yet still can be maintained as such.

The invention claimed is:

1. An electrohydraulic control circuit for driving a hydraulically actuated actuating element, by means of which a segment of a manipulator for truck-mounted concrete pumps can be adjusted in terms of its orientation, comprising:

an electrically driven first valve, which is connected to hydraulic working lines of the actuating element, and check valves provided in the working lines of the actuating element, which check valves are arranged on the actuating element or on the segment associated with the actuating element and can be released for normal operation of the actuating element, wherein the release of the check valves is driven by an electronic control unit separate from the first valve and the check valves, wherein the first valve is arranged on the actuating element or segment associated with the actuating element.

2. The control circuit of claim 1, wherein the control unit is formed as a dedicated electronic unit for the segment.

3. The control circuit of claim 2, wherein the dedicated electronic unit for the segment is arranged on the actuating element or segment associated with the actuating element.

4. The control circuit of claim 1, wherein the working lines of the actuating element are equipped with pressure sensors, of which the signals are fed to the control unit for monitoring the forces and/or moments and/or load acting on the actuating element.

5. The control circuit of claim 1, which is supplied by a pressure supply, wherein a pressure sensor for monitoring the pressure supply is provided, in order to generate a signal, which is fed to the control unit for adaptation of the drive of the first valve to pressure fluctuations detected by the pressure sensor.

6. The control circuit of claim 1, wherein the first valve is embodied as a proportionally acting valve.

7. The control circuit of claim 1, wherein the control unit drives a switching valve, which supplies hydraulic release lines of the check valves.

8. The control circuit of claim 1, wherein the control unit drives the release of the check valves via electromagnetic actuation.

9. The control circuit of claim 1, which comprises a central electronic control unit, which is designed to control a plurality of control circuits of a multiplicity of segments of a manipulator.

10. The control circuit of claim 1, which comprises sensor means associated with the actuating element, which sensor means detect the operating state of the actuating element and/or the spatial orientation of the associated segment and generate corresponding measurement signals, which are guided to an orientation control/regulation unit associated with the segment and/or the manipulator.

11. The control circuit of claim 1, which comprises a hydraulic emergency circuit connected parallel to the first valve.

12. The control circuit of claim 11, wherein the emergency circuit additionally has throttles, which are each connected in series with one of the valves of the emergency circuit.

13. The control circuit of claim 11, wherein the hydraulic emergency circuit has at least one controllable switching valve, which is arranged on the actuating element or segment associated with the actuating element.

14. The control circuit of claim 13, wherein the at least one controllable switching valve is supplied via a dedicated pressure supply line and has mutually coupled valves for achieving a load-holding function.

15. The control circuit of claim 1, wherein at least the first valve is supplied by a pressure supply via an inflow line, wherein a check valve that can be released for the normal operation is arranged in the inflow line, the release of said check valve being controlled by the electronic control unit.

16. The control circuit of claim 1, wherein the working lines of the actuating element are supplied by a first pressure supply and return system, wherein a second pressure supply and return system independent of the first system is provided to supply control lines of the control circuit.

17. A manipulator for truck-mounted concrete pumps, which comprises:

at least one segment and is arranged on a base, wherein the at least one segment is connected to the base via a joint, at which the at least one segment can be pivoted relative to the base about a fixed axis of rotation by means of at least one hydraulically actuated element, wherein the at least one hydraulically actuated element is configured to be driven by the electrohydraulic control circuit of claim 1.

18. The manipulator of claim 17, wherein:

the base is rotatably mounted about a vertical axis of rotation, and the at least one segment comprises at least two segments, a first of which is connected to the base, and the at least two segments are connected to each other via a joint, at which the at least two segments can be pivoted relative to the base or to one another about fixed axes of rotation by means of the at least one hydraulically actuated element.

19. An electrohydraulic control circuit for driving a hydraulically actuated actuating element for adjusting an orientation of a segment of a manipulator for a truck-mounted concrete pump, comprising:

an electrically driven first valve, which is connected to hydraulic working lines of the actuating element;

check valves provided in the hydraulic working lines of the actuating element, which check valves are arranged on the actuating element or on the segment associated with the actuating element and can be released for normal operation of the actuating element;

a hydraulic emergency circuit connected parallel to the first valve; and an electronic control unit, which is configured to drive release of the check valves and is separate from the first valve and the check valves.

* * * * *